United States Patent [19]

Ohchi

[11] Patent Number: 4,848,256

[45] Date of Patent: Jul. 18, 1989

[54] WORKPIECE DETECTOR FOR A SEWING MACHINE

[75] Inventor: Torao Ohchi, Chofu, Japan

[73] Assignee: Tokyo Juki Industrial Co., Ltd., Chofu, Japan

[21] Appl. No.: 54,320

[22] Filed: May 26, 1987

[30] Foreign Application Priority Data

May 26, 1986 [JP] Japan ..... 61-120447

[51] Int. Cl.[4] ..... D05B 29/00; D05B 35/00

[52] U.S. Cl. ..... 112/235; 112/272; 112/277

[58] Field of Search ..... 112/235, 237, 272, 277

[56] References Cited

U.S. PATENT DOCUMENTS 3,968,760 7/1976 Rovin et al. ..... 112/272
4,337,713 7/1982 Palacino et al. ..... 112/272 X
4,363,281 12/1982 Reinke ..... 112/272 X
4,615,287 10/1986 Henze et al. ..... 112/272 X

FOREIGN PATENT DOCUMENTS 56-35192 8/1981 Japan .

*Primary Examiner*—Wm. Carter Reynolds
*Attorney, Agent, or Firm*—Morgan & Finnegan

[57] ABSTRACT

A workpiece detector for a sewing machine including a rotatable detecting lever in which small angular displacements at the end of the detecting lever, caused by differences in workpiece thickness, are multiplied mechanically causing the rotation of an electrical converter. Detectable output signals are generated such that overlapping of workpieces or the end of a workpiece may be detected during stitching. The length of the detecting lever is adjustable such that the detecting point may be varied.

13 Claims, 4 Drawing Sheets

WORKPIECE DETECTOR FOR A SEWING MACHINE

BACKGROUND OF THE INVENTION

1. Field of the Invention

The invention relates to a workpiece end detecting apparatus for a sewing machine. More particularly, the invention relates to an apparatus for detecting not only the workpiece end but also the differences in workpiece thickness.

2. Description of the Prior Art

Conventional industrial lockstitch sewing machines may contain a combination photo sensor and light projector located near the needle entry. This detecting device is effective to sense the workpiece end or the difference in thickness of a workpiece. Such detecting devices are thus able to detect overlapping conditions, for example, when stitching a pocket to a shirt or stitching a label to a workpiece. In some cases, a reflecting type sensor is used in lieu of the above sensor. Non-contact and light-projection type sensors have thus been commonly used, projecting a light from the upper side of the workpiece, the light penetrating through the workpiece and reaching the photo sensor located under the throat plate. The photo sensor detects the workpiece end or the difference of workpiece thickness by sensing the variation of light penetration. Such light-projection type detectors are well-known and widely used because they are simple to operate, are inexpensive and require no contact with the surface of the workpiece.

However, the conventional types of non-contact sensors have drawbacks, including the following:

(1) light-projection type detectors are not applicable where the workpiece is opaque, such as with leather or very thick workpieces;

(2) where the detector is located far from the presser foot, it is difficult to detect correctly because the workpiece is fluttered by the dog-feeding motion, and in such cases some auxiliary pressure is ordinarily needed to stop the fluttering, thereby reducing the advantages of non-contact, photo-sensor type detectors;

(3) to change the location of photo sensor, the throat plate ordinarily has to be changed;

(4) electric wires from the photo sensor are problematic and obstructive when changing the looper thread;

(5) dust or dirt may accumulate on the optical parts of the prior known detectors, lowering the sensitivity of the photo sensor and thus requiring frequent cleaning by the operator;

(6) unintentional obstruction by operator's finger or hand may cause the photo sensor to malfunction.

It is therefore an object of the invention to provide a contact type workpiece detector which eliminates the drawbacks of conventional detector systems, is simply constructed and which may be used for any kind of workpiece.

SUMMARY OF THE INVENTION

These and other objects of the invention are met by providing a workpiece detector for a sewing machine, having a detecting lever with its tip end touching the workpiece. During operation, the displacement at the tip end of the lever due to the variation of workpiece thickness is mechanicaly enlarged, and a converter is energized to convert the displacement to electrical signals which may be used to detect the difference in workpiece thickness. The detecting lever may be adjusted to an effective length. The detector also effectively stops fluttering of the workpiece, and may easily be operated without interference from electric wiring or dust and dirt associated with conventional photo-sensor type devices. Also, the location of the detector may be easily adjusted.

BRIEF DESCRIPTION OF THE DRAWINGS

The invention will be described in greater detail below with reference to the accompanying drawings, wherein.

DETAILED DESCRIPTION OF THE DRAWINGS

Figure 1:
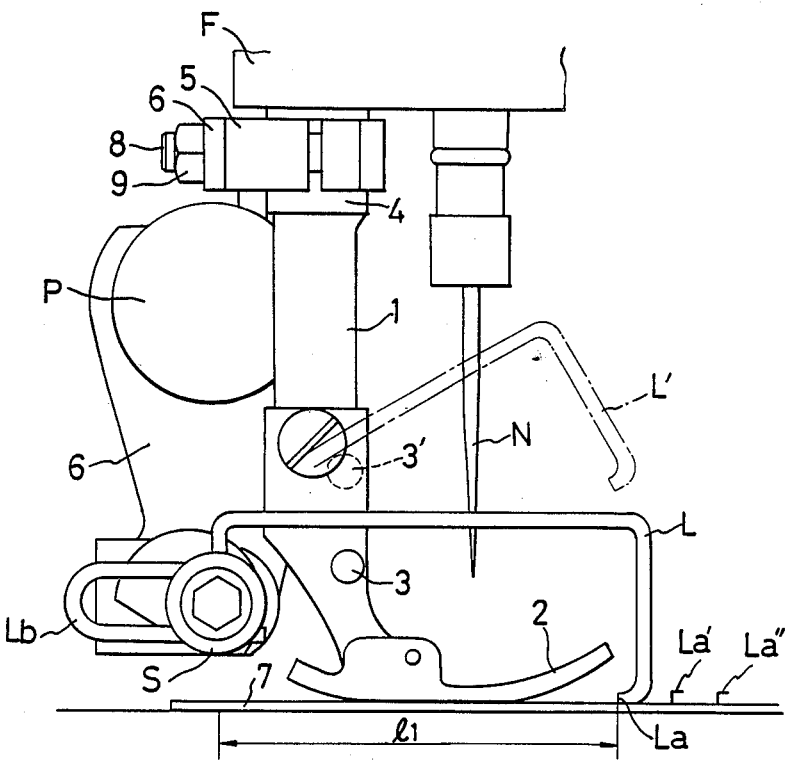
FIG. 1 is a side view drawing of one preferred embodiment of a workpiece detector according to the invention.
Figure 2:
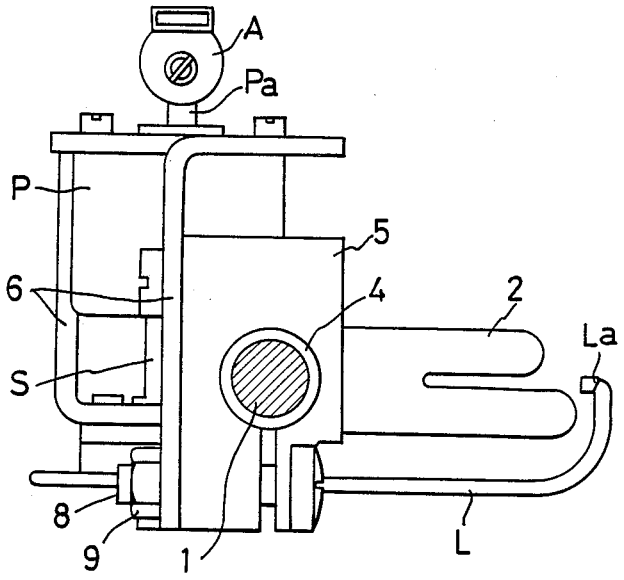
FIG. 2 is a top view of the embodiment of FIG. 1.

One preferred embodiment of the invention is shown in FIGS. 1–4. The embodiment shown in the drawings includes a frame F, a presser bar 1, a presser foot 2, and a lift pin 3 which is fixed to the presser foot assembly and lifts a detecting lever L (explained later) instantaneously when the presser foot 2 is raised.

Referring to FIG. 1, the dotted line drawing of detecting lever L′ shows the forward portion of the detecting lever L as it would be raised by the lift pin 3 which is itself lifted to the position shown by the dotted drawing of the lift pin 3′ as the presser foot 2 is raised to release the workpiece.

FIGS. 1–4 also illustrate a metal-busing 4 and a fixing-block 5 which clamps the metal-busing 4. A bracket 6 may be clamped or otherwise fixed to the fixing-block 5 by a screw 8 and nut 9 through oblong holes 10 (see FIG. 5).

At lower portion of the bracket 6, a shaft S is rotatably sustained. The shaft S preferably extends horizontally. At the end of the shaft S, a detecting lever L is provided. Detecting lever L detects the workpiece end or the difference in workpiece thickness brought about by overlapping workpieces. Tip end La of the detecting lever L forms a detector which touches the workpiece placed on a throat plate 7.

Figure 3:
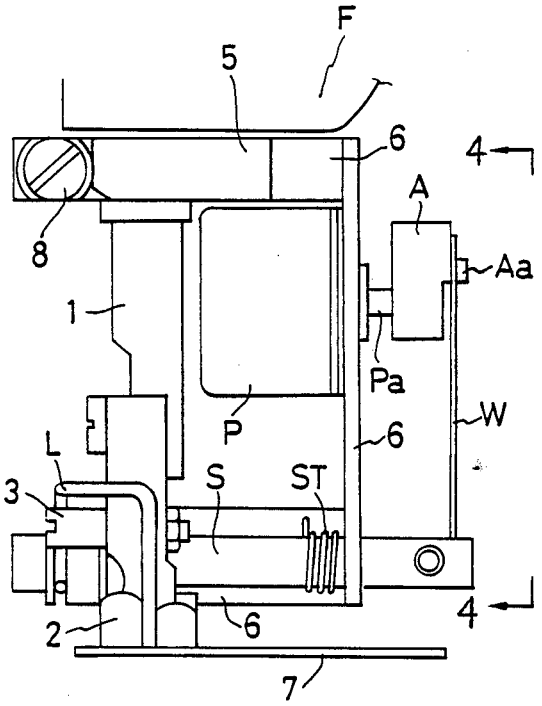
FIG. 3 is a front view of the embodiment of FIG. 1.

Referring to FIG. 3, a torsional spring ST winding around the shaft S effectively presses the detector La against the workpiece placed on the throat plate 7 with a predetermined pressure. At end of the shaft S opposite the detecting lever L, a transmitting arm W which is preferably a displacement-multiplying lever is fixed and extends upwardly. This displacement-multiplying lever W is preferably made of flexible, resilient wire. The upper end of the displacement-multiplying lever W may be configured as a fork or loop which surrounds with some clearance a pin Aa which projects from an arm A to which a rotation shaft Pa of a potentiometer P is fixedly inserted. The looped end of lever W preferably surrounds pin Aa without friction between the pin and the side edges of the loop.

Referring to FIG. 1, the end of the detecting lever L opposite the tip end La forms a loop Lb such that the effective length $l_1$ of the detecting lever L may be adjusted by moving the loop Lb across the shaft S. Thus the position of the detecting tip La can be adjusted as shown by La, La', La'' of FIG. 1.

Figure 4:
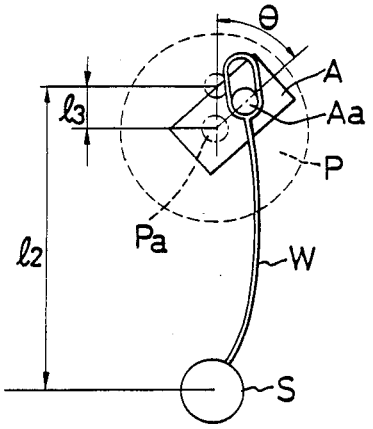
FIG. 4 is a partial side view of the embodiment of FIG. 3 taken in direction of 4—4.
Figure 5:
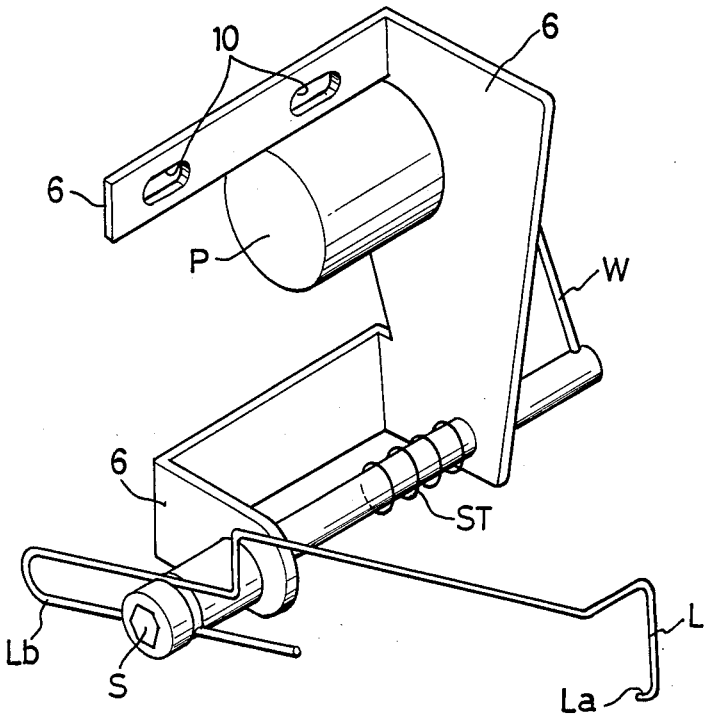
FIG. 5 is a perspective view of a workpiece detector according to the invention dismounted from a sewing machine.

The lift pin 3 may be located approximately 2 mm below the detecting lever , thereby not touching the detecting lever L during ordinary stitching. Lift pin 3 lifts up the detecting lever L when the presser foot 2 is raised after stopping the machine. The lifted position is shown by the dotted lines in FIG. 1 for the detecting lever L and by the dotted lines for the lift pin 3. FIG. 4 is a partial side view of the embodiment of FIG. 3 shown in direction of 4—4 and shows the action of displacement-multiplying lever W.

As shown in FIG. 1, during stitching, the detecting tip La detects the workpiece end or the difference in thickness of overlapping workpieces which are placed on the throat plate 7 and are pressed by the foot presser 2. The detecting tip La is located a short distance from the needle entry on the operator's side. As the detecting tip La detects the workpiece end or the difference in thickness of overlapping workpieces, the detecting lever L displaces slightly in a downward or upward direction, pivoting about the center of rotation of the shaft S, and simultaneously rotates the shaft S clockwise or counter clockwise accordingly.

As the shaft S rotates, the displacement-multiplying lever W is displaced causing the arm A to rotate in the same direction. As the arm A rotates, the rotation shaft Pa of the potentiometer P rotates and its rotated angle is multiplied.

For example, if the difference in the workpiece thickness (overlapping) is 0.5 mm, the rotated angle (FIG. 4) of the arm A at the potentiometer P will be defined as follows:

$$\text{(degrees) } \theta = \frac{0.5\text{ mm}}{l_1} \times \frac{l_2}{l_3} \times \frac{180}{\pi}\text{, where}$$

$l_1$ = the effective length of the detecting lever L.

$l_2$ = the effective length of the displacement-multiplying lever W, and $l_3$ = the distance between the center of shaft Pa and the center of pin Aa.

As the above formula shows, the displacement of detecting lever L will be multiplied enough so that the change in electrical output from potentiometer P will be large enough to be detectable.

The driving force necessary to rotate the potentiometer P is likely very small, so even a thin wire will generally be adequate as a displacement-multiplying lever W.

Moreover, when the detecting lever L is raised by the lift pin 3 and the shaft Pa rotates to its maximum degree, the displacement-multiplying lever W deflects and absorbs the rotational force since the displacement-multiplying lever W is preferably made of thin flexible or resilient wire. When the presser foot 2 descends, the arm A resumes its home position.

It will, of course, be understood that the invention is not limited to the preferred embodiments herein described. Other displacement multiplying mechanisms will be applicable, and in lieu of the potentiometer, any other means of generating a detectable change in an electrical parameter will also be applicable.

The invention therefore is not limited to the embodiments herein described, but should be interpreted only in accordance with the claims which follow.

I claim:

1. A workpiece detector for a sewing machine, comprising:

a detecting lever secured substantially perpendicularly to a rotating shaft, said lever pivoting about a center of rotation of said shaft, said pivoting caused by a displacement of a tip end of said lever, said shaft rotating according to the pivoting of said lever;

motion transmitting means secured at one end about said shaft substantially perpendicularly thereto, said transmitting means being further secured at another end thereof to means for altering an electrical output, said electrical output being altered relative to the displacement of said tip end.

2. A workpiece detector, according to claim 1, wherein said motion transmitting means terminates as a loop at the end thereof secured to said means for altering said loop engaging an arm extending from said means for altering, rotation of said arm varying said electrical output.

3. A workpiece detector, according to claim 1, wherein said transmitting means is adapted to multiply the displacement of said detecting lever and to transmit said multiplied displacement to said means for altering.

4. A workpiece detector according to claim 1, wherein said detecting lever is slidably secured to said shaft such that a distance between the tip end and the center of rotation of said shaft may be adjusted.

5. A workpiece detector for a sewing machine, as recited in claim 1, wherein said shaft is rotatably provided within a bracket, and restoring means are provided between said shaft and said bracket for restoring said shaft to a home position, the pivoting of said detecting lever causing said shaft to be rotated within said bracket relative to said home position.

6. A sewing machine, comprising:

a throat plate, a presser foot secured to a machine frame at a position above said throat plate, and a workpiece detector according to claim 1 secured to said machine frame such that the tip end of said detecting lever extends in front of said presser foot above said throat plate such that a workpiece passing between said presser foot and said throat plate first passes between said tip end and said throat plate, the passage of said workpiece beneath said tip end causing said displacement of said tip end.

7. A sewing machine, comprising:

a throat plate, a presser foot secured to a machine frame at a position above said throat plate, and a workpiece detector according to claim 4 secured to said machine frame such that the tip end of said detecting lever extends in front of said presser foot above said throat plate such that a workpiece passing between said presser foot and said throat plate first passes between said tip end and said throat plate, the passage of said workpiece beneath said tip end causing said displacement of said tip end.

8. A sewing machine, comprising:

a throat plate, a presser foot secured to a machine frame at a position above said throat plate, and a workpiece detector according to claim 5 secured to said bracket such that the tip end of said detecting lever extends in front of said presser foot above said throat plate such that a workpiece passing between said presser foot and said throat plate first passes between said tip end and said throat plate, the passage of said workplace beneath said tip end causing said displacement of said tip end.

9. A workpiece detector for a sewing machine having a presser bar mounted thereto with a bushing, a fabric presser foot mounted on a lower end of said presser bar, comprising:

a pivoting detecting lever;

means for transmitting a displacement of said detecting lever mechanically linked to said lever; and means for varying an electrical parameter linked to said transmitting means; said pivoting detecting lever being positioned upon said sewing machine so that a tip end thereof is displaced relative to differences in thickness of a workpiece, the displacement of said tip end being transmitted by said transmitting means to said electrical parameter varying means such that a variation in an electrical parameter is generated relative to said displacement, wherein the work detector is mounted to said bushing.

10. A workpiece detector for a sewing machine, comprising:

a pivoting detecting lever;

means for transmitting a displacement of said detecting lever mechanically linked to said lever; and means for varying an electrical parameter linked to said transmitting means; said pivoting detecting lever being positioned upon said sewing machine so that a tip end thereof is displaced relative to differences in thickness of a workpiece, the displacement of said tip end being transmitted by said transmitting means to said electrical parameter varying means such that a variation in an electrical parameter is generated relative to said displacement;

wherein said displacement transmitting means comprises:

(a) a shaft engaged at one end of said shaft by said detecting lever such that verical movement in said detecting lever due to changes in workpiece thickness causes rotation of said shaft;

(b) a displacement multiplying lever having a lower end engaged with another end of said shaft, rotation of said shaft causing a vertical displacement in said displacement multiplying lever;

(c) an arm pin slidably engaged with the upper end of said displacement multiplying lever;

(d) an arm fixed to said arm pin and said electrical parameter varying means such that vertical displacement of said displacement multiplying lever slidably engaged with said arm pin causes said arm to rotate causing said electrical parameter varying means to vary said electrical parameter.

11. A workpiece detector according to claim 10 wherein said electrical parameter varying means comprises a potentiometer.

12. A workpiece detector according to claim 10 wherein the end of said detecting lever opposite the tip end is configured as a loop whereby the effective length of said detecting lever may be adjusted by moving said loop across said shaft.

13. A workpiece detector according to claim 10 wherein said displacement multiplying lever consists of a flexible, resilient wire.

* * * * *